United States Patent [19]

Edwards

[11] Patent Number: 5,004,922

[45] Date of Patent: Apr. 2, 1991

[54] OPTICAL FIBER SCANNING SYSTEM FOR HEAT SENSING

[75] Inventor: Stanley A. Edwards, Wallasey, United Kingdom

[73] Assignee: United Kingdom Atomic Energy Authority, London, England

[21] Appl. No.: 421,940

[22] Filed: Oct. 16, 1989

[51] Int. Cl.[5] ..... G08B 17/12

[52] U.S. Cl. ..... 250/340; 250/347; 250/349; 340/578

[58] Field of Search ..... 250/340, 347, 342, 349; 340/600, 578

[56] References Cited

U.S. PATENT DOCUMENTS 4,533,834 8/1985 McCormack ..... 250/339
4,648,462 3/1987 Odashima ..... 250/347
4,730,113 3/1988 Edwards ..... 250/347

FOREIGN PATENT DOCUMENTS 1580272 12/1980 United Kingdom .
1583700 1/1981 United Kingdom .
2216254 10/1989 United Kingdom .

*Primary Examiner*—Carolyn E. Fields
*Assistant Examiner*—Drew A. Dunn
*Attorney, Agent, or Firm*—William R. Hinds

[57] ABSTRACT

For the detection of heat sources within an area to be maintained under surveillance, several scanning units at different scanning stations are linked to a common radiation sensor by respective optical fibre transmission elements. A gating means, such as a rotary mask with an opening, is indexed stepwise to gate each transmission element in turn to the common sensor.

8 Claims, 1 Drawing Sheet

OPTICAL FIBER SCANNING SYSTEM FOR HEAT SENSING

This invention relates to a scanning system for the detection of heat sources.

In a known scanning system disclosed in our prior published European patent application No. 0200289, an area to be kept under surveillance for detection of a hot spot is scanned by one or more scanning units receptive of infra-red emissions as an indicator of the occurrence of such a hot spot. The present invention has particular application to a scanning system of this type when the system employs two or more scanning units at different scanning stations.

According to the present invention there is provided a scanning system for the detection of heat sources within an area to be maintained under surveillance, comprising two or more scanning units, optical scanning means for each scanning unit for cyclically scanning at least part of the area, a radiation sensor responsive to radiation indicative of a heat source and located remotely from the scanning units, optical fibre transmission elements each associated with a respective scanning unit for transmitting radiation received by the associated scanning unit to the radiation sensor which is thereby common to all of the scanning units, the transmission elements being arranged at their outlet ends in spaced relation, a masking member interposed between the outlet ends and the common radiation sensor for gating the radiation transmitted by each optical fibre transmission element so that radiation from only one transmission element at a time is incident on the radiation sensor, the masking member having an opening and being movable in a cyclic fashion to bring the opening into registry for a dwell period, one at a time, with each transmission element so that the radiation transmitted by the respective transmission element may impinge on the common sensor for that period, the masking member being arranged such that each transmission element is gated in turn to the common sensor for a period equivalent to a complete cycle of the associated scanning unit, and control circuitry so arranged that cycle completion pulses generated at the scanning units trigger indexing of the masking member from one scanning unit to the next scanning unit.

Each of the scanning units may be constructed and designed to operate in the manner disclosed in our prior European patent application No. 0200289 but, instead of the radiation collected by the optical arrangement of the scanning unit being directed on to a radiation sensor housed within the scanning unit, the radiation is directed into a fibre optic transmission element and transmitted to a single remote radiation sensor common to all of the scanning units. In this way, a reduction in costs for the system may be possible and the radiation sensor may be isolated from hazardous environments in which the scanning units may be required to operate.

Figure 1:
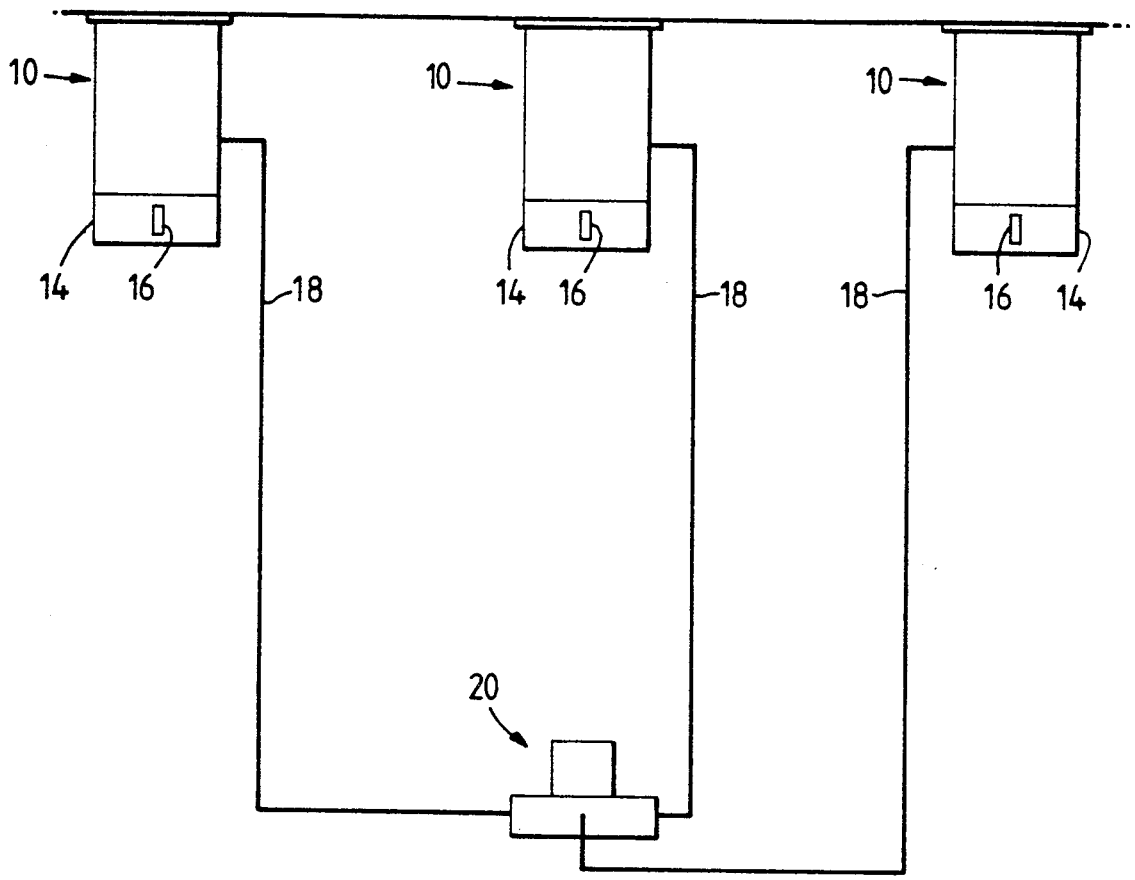
Figure 2:
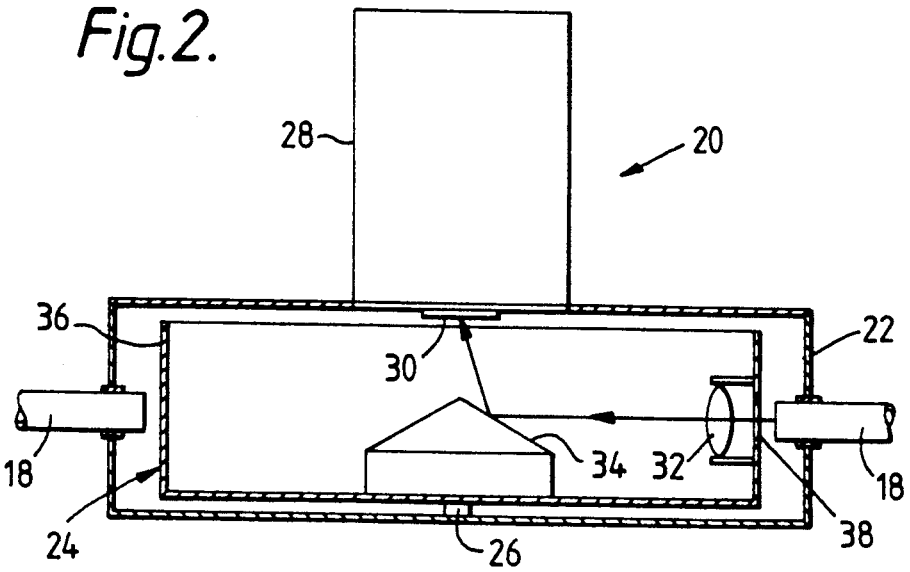

The invention will now be described by way of example only with reference to the accompanying drawings in which:

FIG. 1 is a diagrammatic view of a scanning system according to the invention; and FIG. 2 is a diagrammatic side view of the common radiation sensor and gating arrangement.

As shown in FIG. 1, the scanning system comprises a number of scanning units 10 at different scanning stations, each of which units 10 may be generally constructed and arranged to operate in the manner described in our prior European patent application No. 0200289 (see in particular FIG. 4 and the related description thereof for further details). Each scanning unit 10 has a fixed housing and a rotatably driven scanning head 14 incorporating an anamorphic lens 16 forming part of an optical arrangement for providing an extended field of view which typically subtends a solid angle of 180°×1°, e.g. 180° in a vertical plane and 1° in the horizontal direction. This field of view is condensed optically and coupled into an infra-red optical fibre 18 for transmitting the radiation collected to a detector unit 20, such fibre 18 being selected for high transparency over a broad spectrum of the infra-red range of wavelengths and for low attenuation in this spectrum. Recourse may be appropriate to chalcogenide glass fibre, such as arsenic trisulphide or arsenic triselenide, or to heavy metal fluoride glass fibre, such as of one of the fluorozirconate, fluorohafnate or barium-thorium glasses. A suitable choice may be the fibre "Red Vycor" as manufactured by Corning.

As shown schematically in FIG. 2, the detector unit 20 comprises a housing 22 to which the terminal outlet ends of the optical fibres 18 are connected at equiangularly spaced positions, e.g. at 90° intervals where four scanning units 10 are employed. The housing 22 has a rotary annular gating member, or shutter, 24 mounted therein for rotation about the axis of mounting stub 26, the gating member 24 being coaxial with the stub 26 and being driven rotatably in indexed fashion by a stepping motor (not shown) located within housing 28. An infra-red sensor 30 (e.g. a lead selenide, a cadmium mercury telluride or a lead tin telluride sensor) is mounted within the housing 28 and radiation transmitted by the optical fibres 18 is directed onto the sensor 30 by a lens 32 and reflector 34, the latter components 32, 34 being mounted on the rotatary gating member 24.

The gating member 24 has a circumferential wall 36 which is uninterrupted except for an opening 38 disposed at the same level as the terminal ends of the optical fibres 18. The lens 32 is located in registry with the opening 38 and the circumferential extent of the opening 38 is such that radiation from only one optical fibre 18 at a time cam pass through the gating member 24 for reflection onto the sensor 30.

In operation, the gating member 24 is indexed rotatably at high speed between indexing positions to bring the opening 38 successively into registry with each optical fibre 18 in turn. At each indexing position, the sensor 30 therefore receives radiation collected by a respective scanning unit 10. The dwell period at each indexing position is most simply arranged to be equivalent to a complete cycle at each scanning station, the period then being constant if all the cycle times are the same. Stepping from one indexing position to the next may be triggered, through control circuitry, by cycle completion pulses generated at the scanning units. Such an arrangement enables different cycle times to be accommodated.

The housing 28 may incorporate signal processing electronics for amplifying the electrical out-put of the sensor 30 and correlating the signals from the sensor 30 with the instantaneous position of the gating member 24 to produce output signals identifying the particular scanning unit 10 which the sensor 30 is, at that instant, responding to together with the infra-red radiation intensity seen by that scanning unit 10. The output signals may be fed to a computer-based monitor (not shown)

for analysing the signals and determining whether any undesirable sources of heat are present or are developing within the area under surveillance. Also the monitor may operate to correlate the signals derived from the scanning units 10 to determine, by triangulation techniques, the position of any hot spot detected within the area under surveillance. In the event of detection of a hot spot, the monitor may produce a warning signal and/or initiate remedial action, e.g. shut-down or modification of operation of a laser tool if the system is used to protect against stray laser beams, or, if the system is used to monitor for incipient fires, to operate fire-extinguishing means such as water sprinklers in the vicinity of the fire hazard.

I claim:

1. A scanning system for the detection of heat sources within an area to be maintained under surveillance, comprising two or more scanning units, optical scanning means for each scanning unit for cyclically scanning at least part of said area, a radiation sensor responsive to radiation indicative of a heat source and located remotely from the scanning units, optical fibre transmission elements each associated with a respective scanning unit for transmitting radiation received by the associated scanning unit to the radiation sensor which is thereby common to all of the scanning units, the transmission elements being arranged at their outlet ends in spaced relation, a masking member interposed between the outlet ends and the common radiation sensor for gating the radiation transmitted by each optical fibre transmission element so that radiation from only one transmission element at a time is incident on the radiation sensor, the masking member having an opening and being movable in a cyclic fashion to bring the opening into registry for a dwell period, one at a time, with each transmission element so that the radiation transmitted by the respective transmission element may impinge on the common sensor for that period, the masking member being arranged such that each transmission element is gated in turn to the common sensor for a period equivalent to a complete cycle of the associated scanning unit, and control circuitry so arranged that cycle completion pulses generated at the scanning units trigger indexing of the masking member from one scanning unit to the next scanning unit.

2. A system as claimed in claim 1, wherein the transmission elements are directed radially at a common axis in equi-angular relationship and in a common plane, the common radiation sensor is displaced from the common plane and locates on the common axis, and reflector means are provided for reflecting the radiation from the transmission elements onto the common radiation sensor.

3. A system as claimed in claim 2, wherein a lens at the opening is adapted to direct the radiation from a respective transmission element onto the reflector means.

4. A system s claims in claim 2, wherein a monitor means is provided for analysing the output siganls of the common radiation sensor.

5. A system as claimed in claim 4, wherein the monitor means is adapted to correlate the output signals to determine the position of the heat source.

6. A system as claimed in claim 4, wherein the monitor means is adapted to provide an output to initiate remedial action against a heat source detected by the system.

7. A system as claimed in claim 2, wherein the reflector means is mounted on the masking member, and the masking member and thereby the reflector means rotate about the common axis.

8. A system as claimed in claim 7, wherein the masking members is arranged to be moved in indexed fashion by stepping motor means.

* * * * *